US007354214B2

(12) United States Patent
Sawai

(10) Patent No.: US 7,354,214 B2
(45) Date of Patent: Apr. 8, 2008

(54) IMAGE FORMING APPARATUS HAVING A CHASSIS CONTAINING A CURVED PART THAT SUPPORTS A ROLLER BEARING

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/171,252

(22) Filed: Jul. 1, 2005

(65) Prior Publication Data

US 2006/0013635 A1 Jan. 19, 2006

(30) Foreign Application Priority Data

Jul. 13, 2004 (JP) ..... 2004-205535

(51) Int. Cl.
*B41J 29/02* (2006.01)

(52) U.S. Cl. ..... 400/693; 400/691; 400/692; 400/636.2; 400/636.3; 101/391; 101/392

(58) Field of Classification Search ..... 400/693, 400/691, 636, 636.1, 636.2; 101/391, 392
See application file for complete search history.

(56) References Cited

U.S. PATENT DOCUMENTS

| | | | | |
|---|---|---|---|---|
| 3,502,325 | A * | 3/1970 | Wilson et al. | 271/111 |
| 3,754,754 | A * | 8/1973 | Peterson | 271/122 |
| 4,516,866 | A * | 5/1985 | Yamauchi et al. | 400/25 |
| 4,802,780 | A * | 2/1989 | Yokoi | 400/643 |
| 4,815,879 | A * | 3/1989 | Yokoi | 400/636 |
| 4,944,621 | A * | 7/1990 | Uecker | 400/691 |
| 5,742,318 | A * | 4/1998 | Miyauchi et al. | 347/134 |
| 5,971,638 | A * | 10/1999 | Sato et al. | 400/578 |
| 6,171,002 | B1 * | 1/2001 | Momose et al. | 400/73 |
| 6,634,819 | B2 * | 10/2003 | Uchida | 400/691 |
| 2005/0072329 | A1 * | 4/2005 | Saeki | 101/407.1 |

FOREIGN PATENT DOCUMENTS

| | | |
|---|---|---|
| JP | 63-113029 | 7/1988 |
| JP | 02-286537 | 11/1990 |
| JP | 04-2653 | 1/1992 |
| JP | 04349771 A * | 12/1992 |
| JP | 05-069964 | 3/1993 |
| JP | 05-212923 | 8/1993 |

(Continued)

*Primary Examiner*—Ren Yan
*Assistant Examiner*—Matthew Marini
(74) *Attorney, Agent, or Firm*—Global IP Counselors, LLP

(57) ABSTRACT

The image forming apparatus includes a chassis, a feed roller, and a press roller. The chassis includes first and side surfaces, a bottom surface that connects the first and second side surfaces, and a curved part formed unitarily with the bottom surface. The curved part has a feed roller bearing support portion. The feed roller is rotatably supported between the first and second side surfaces via feed roller support bearings for conveying paper. The feed roller bearing support portion of the curved part supports one of the feed roller support bearings. The press roller is rotatably supported between the first and second side surfaces for pressing on the feed roller. The feed roller has a paper conveying portion that has a plurality of projecting portions. A widthwise center of the paper conveying portion substantially matches with a widthwise center between the pair of feed roller bearings.

8 Claims, 11 Drawing Sheets

FOREIGN PATENT DOCUMENTS

| | | | |
|---|---|---|---|
| JP | 06-155828 | A | 6/1994 |
| JP | H06-52057 | U | 7/1994 |
| JP | 09-211985 | A | 8/1997 |
| JP | 2001-016824 | A | 1/2001 |
| JP | 2001-088975 | | 4/2001 |
| JP | 2004-018194 | | 1/2004 |

* cited by examiner

PRIOR ART

IMAGE FORMING APPARATUS HAVING A CHASSIS CONTAINING A CURVED PART THAT SUPPORTS A ROLLER BEARING

BACKGROUND OF THE INVENTION

1. Field of the Invention

The present invention relates to an image forming apparatus. More specifically, the present invention relates to an image forming apparatus that has a feed roller and a press roller.

2. Background Information

Heat transfer printers and other such image forming apparatuses that have a feed roller and a press roller are well known. FIG. 14 is a perspective view showing the entire configuration of an example of a conventional heat transfer printer. FIG. 15 is a plan view of the conventional heat transfer printer shown in FIG. 14. FIGS. 16 through 19 are diagrams for describing the structure of the conventional heat transfer printer shown in FIG. 14. The structure of the conventional heat transfer printer will now be described with reference to FIGS. 14 through 19.

As shown in FIGS. 14 and 15, a conventional heat transfer printer has a metal chassis 101, a metallic feed roller 102 for feeding paper, a metallic press roller 103 for coming into contact with the feed roller 102 with a specific amount of pressure, a separating member 104, a resinous feed roller bearing 105 for rotatably supporting the feed roller 102, a resinous press roller bearing 106 for rotatably supporting the press roller 103, a feed roller gear 107 mounted on the feed roller 102, a metallic press arm 108, a tension coil spring 109, a motor 110 for driving the feed roller 102 and the like, a thermal head 111 for printing, a platen roller 112, a resinous platen roller bearing 113 for rotatably supporting the platen roller 112, a pressing member 114, a torsion coil spring 115, a motor 116 for driving the thermal head 111, an ink sheet take-up gear 117, a roller axle 118, a rubber paper supply/eject roller 119 mounted on the roller axle 118, a roller axle gear 120 mounted on the roller axle 118, a motor bracket 121, a drive gear 122, and intermediate gears 123, 124, and 125.

As shown in FIG. 14, the aforementioned motor bracket 121 is mounted on the first side surface 101*a* of the chassis 101. Also, an ink sheet insertion part 101*c* through which ink sheets (not shown) are inserted is provided to the second side surface 101*b* of the chassis 101. A spring mounting hole 101*d* in which one end of the tension coil spring 110 is mounted is formed in the second side surface 101*b* of the chassis 101.

The feed roller 102 has a bearing support portion 102*a* on the side of the chassis 101 with the first side surface 101*a*, a bearing support portion 102*b* on the side of the chassis 101 with the second side surface 101*b*, a gear insertion part 102*c*, and a paper conveying unit 102*d*, as shown in FIG. 16. The bearing support portions 102*a* and 102*b* of the feed roller 102 have a smaller diameter than that of the portion of the feed roller 102 between the bearing support portions 102*a* and 102*b*. Also, the bearing support portions 102*a* and 102*b* are rotatably supported on feed roller bearings 105. The feed roller bearings 105 are mounted using screws 126 on the first side surface 101*a* and second side surface 101*b* of the chassis 101, as shown in FIGS. 18 and 19. The gear insertion part 102*c* on the outer side of the bearing support portion 102*a* fits into the insertion hole 107*a* in the feed roller gear 107 so as not to be relatively rotatable. Also, convex portions having a predetermined height are formed by the roll-forming on the surface of the paper conveying portions 102*d* of the feed roller 102, as shown in FIG. 16. The paper conveying portion 102*d* is a portion of the surface of the feed roller 102 where the convex portions are formed.

As shown in FIG. 16, the bearing support units 103*a* and 103*b* of the press roller 103 have a smaller diameter than the portion of the press roller 103 between the bearing support portions 103*a* and 103*b*. Metallic separating members 104 that have a greater diameter than the press roller 103 is mounted on the bearing support portions 103*a* and 103*b* of the press roller 103. The separating members 104 come into contact with the outermost peripheral surface of the feed roller 102 so as to prevent the distal end of the convex portions on the paper conveying unit 102*d* of the feed roller 102 from coming into contact with the press roller 103. Press roller bearings 106 are mounted on the press arm 108 provided to the inner side of both the first side surface 101*a* and the second side surface 101*b* of the chassis 101. The press arms 108 are mounted on the first side surface 101*a* and the second side surface 101*b* of the chassis 101 so as to be capable of pivoting around the support unit 108*a*, as shown in FIG. 14. The first end of the tension coil spring 109 for urging the press roller 103 to press on the feed roller 102 is mounted in the spring mounting hole 110*d* of the chassis 101. The second end of the tension coil spring 109 is coupled to a spring mounting part 108*b* of the press arm 108.

The thermal head 111 is coupled to the inner sides of the first side surface 101*a* and second side surface 101*b* of the chassis 101 to be capable of pivoting around a supporting axle 111*a*, as shown in FIG. 14. The torsion coil spring 115 is coupled to the supporting axle 111*a*, as shown in FIG. 15. The torsion coil spring 115 urges the thermal head 111 in a direction away from the platen roller 112 (direction of the arrow F in FIG. 14). Also, when the thermal head 111 receives the driving force from the motor 116 transmitted via the drive gear 122 and the pressing member 114, and therefore pivots in the direction of the arrow E in FIG. 14 and presses on the platen roller 112.

The platen roller 112 has a bearing support portion 112*a* on the side of the first side surface 101*a* of the chassis 101, and a bearing support portion 112*b* on the side of the second side surface 101*b* of the chassis 101, as shown in FIG. 17. The bearing support portions 112*a* and 112*b* are rotatably supported on the platen roller bearings 113. The platen roller bearings 113 are mounted by screws 126 on the first side surface 101*a* and the second side surface 101*b* of the chassis 101, as shown in FIGS. 18 and 19.

The driving force from the motor 110 is transmitted to the feed roller gear 107 via the intermediate gear 123, as shown in FIGS. 14 and 15. The motor 110 is mounted on the motor bracket 121. The motor 110 also functions as a drive source for driving the feed roller 102, the ink sheet take-up member (not shown), and the roller axle 118. The feed roller gear 107 engages the intermediate gears 123 and 124. The intermediate gears 124 transmit the driving force from the feed roller gear 107 to the ink sheet take-up gear 117 fitted over the ink sheet take-up roller (not shown). The intermediate gears 124 also transmit the driving force from the feed roller gear 107 to the roller axle 118 on which the paper supply/eject roller 119 is mounted via the roller axle gear 120.

The relationship between the positions of the feed roller 102, the press roller 103, and the paper 127 in this heat transfer printer will now be described with reference to FIGS. 15 and 16. In FIGS. 15 and 16, the center position of the paper 127 in the width direction (the direction of the arrow X in FIG. 15), which is orthogonal to the conveyance direction (of the arrow Y in FIG. 15) of the paper 127, is denoted by L4, the center position (center line) of the distance between the feed roller bearings 105 is denoted by L5, and the center position (center line) of the distance between the press roller bearings 106 is denoted by L6.

Furthermore, the distal position of the feed roller bearing 105 mounted on the first side surface 101*a* side is denoted by P3, and the distal position of the feed roller bearing 105 mounted on the second side surface 101*b* side is denoted by P4. The feed roller 102 is rotatably supported on the feed roller bearings 105 mounted on the first side surface 101*a* and the second side surface 101*b* of the chassis 101, as shown in FIGS. 15 and 16. The center position L5 between the position P3 of the feed roller bearing 105 mounted on the first side surface 101*a* and the position P4 of the feed roller bearing 105 mounted on the second side surface 101*b* is thereby the center position of the distance between the first side surface 101*a* and the second side surface 101*b* of the chassis 101.

As shown in FIG. 15, the center position L4 of the width direction of the paper 127 (the direction of the arrow X in FIG. 15), which is also the center of the paper conveying unit 102*d*, is displaced toward the second side surface 101*b* of the chassis 101 relative to the center position of the distance between the first side surface 101*a* and second side surface 101*b* of the chassis 101 or the center position L4 because the drive gear 122 that drives the pressing member 114 for pressing on the thermal head 111 is disposed on the inner surface of the first side surface 101*a*. In other words, the center position L5 of the distance between the pair of feed roller bearings 105 does not match the center position L4 of the paper 127.

Also, as shown in FIG. 16, the press roller 103 is rotatably supported by the press roller bearings 106 mounted on the press arms 108 that are provided to the inner sides of the first side surface 101*a* and second side surface 101*b* of the chassis 101. As shown in FIG. 16, the center position L6 of the distance between the press roller bearings 106 substantially coincides with the center position L5 of the distance between the feed roller bearings 105, but does not coincide with the center position L4 of the paper 127.

Next, the operation of feeding paper 127 in the heat transfer printer according to the conventional example will be described with reference to FIGS. 14 and 15. In the feed operation of the conventional heat transfer printer 127, the driving force of the motor 110 is transmitted to the feed roller gear 107 via the intermediate gear 123, as shown in FIGS. 14 and 15. The feed roller 102 thereby rotates. The driving force of the motor 110 is transmitted from the feed roller gear 107 to the ink sheet take-up gear 117 via the intermediate gear 124, and the ink sheet (not shown) is therefore rolled. The driving force of the motor 110 is also transmitted from the feed roller gear 107 to the roller axle gear 120 via the plurality of intermediate gears 124, and the paper 127 therefore is conveyed in the paper supply direction or the paper ejection direction.

During the printing operation, the thermal head 111 is pivoted in a direction in which pressure is applied to the platen roller 112 (the direction of the arrow E) by the motor 116. When the paper is conveyed in the opposite direction (the direction of the arrow H), the thermal head 111 pivots in a direction away from the platen roller 112 (the direction of the arrow F). As a result, during the printing operation, the paper 127 is held between the thermal head 111 and the platen roller 112 and is conveyed forward (in the direction of the arrow G) by the feed roller 102 and the press roller 103. As the paper 127 is to be conveyed in the opposite direction (the direction of the arrow H), the paper 127 is conveyed while being held between the feed roller 102 and the press roller 103.

In the conventional printer shown in FIGS. 14 through 19, there is no match between the center position L4 of the paper 127, the center position L5 between the feed roller bearings 105, and the center position L6 between the press roller bearings 106. As a result, there is no match between the center position L4 of the paper 127 and the center position L6 between the points in which pressure is applied to the feed roller 102 by the press roller 103 (positions in which pressure is applied by the press arms 108). The pressure applied to the paper 127 by the press roller 103 is thereby not uniform in the transverse direction, and the paper 127 tends to be conveyed in a direction not orthogonal to the width direction of the paper 127. As a result, the precision with which the paper 127 is fed is therefore compromised.

In view of the above, it will be apparent to those skilled in the art from this disclosure that there exists a need for an improved image transfer apparatus that overcomes the problems of the conventional art. This invention addresses this need in the art as well as other needs, which will become apparent to those skilled in the art from this disclosure.

SUMMARY OF THE INVENTION

An object of the present invention is to provide an image forming apparatus wherein the precision with which paper is fed can be improved.

The image forming apparatus according to the first aspect of the present invention includes a chassis with a first side surface, a second side surface, a bottom surface that connects the first and second side surfaces, and a curved part formed unitarily with the bottom surface, the curved part having a feed roller bearing support portion; a feed roller rotatably supported between the first and second side surfaces via a pair of feed roller support bearings for conveying paper, one of the feed roller support bearings being supported by the feed roller bearing support portion of the curved part; and a press roller rotatably supported between the first and second side surfaces for pressing on the feed roller with a predetermined amount of pressure. One of the feed roller and the press roller has a paper conveying portion that has a plurality of projecting portions. A widthwise center of the paper conveying portion substantially matches with a widthwise center between the pair of feed roller bearings.

In the image forming apparatus described above, a curved part having a feed roller bearing support unit for supporting one of the feed roller bearings is provided unitarily with the bottom surface of the chassis, and the curved part is disposed such that when the paper is conveyed, there is a substantial match between the widthwise center of the paper conveying portion and the center position of the distance between the pair of feed roller bearings. Thus, the center position of the distance between the pair of feed roller bearings can be made to substantially coincide with the center position of the paper disposed at a specific location.

Also, by providing the curved part having the feed roller bearing support portion unitarily with the bottom surface of the chassis, it is possible to improve the precision with which paper is fed without having to increase the number of components.

The image forming apparatus according to the second aspect of the present invention further includes a pair of press roller bearings for rotatably supporting both ends of the press roller; and a pair of press arms for pressing the press roller against the feed roller with a predetermined amount of pressure, each of the pair of press roller bearings being mounted on each of the press arms. The curved part further has a press arm support portion for rotatably supporting one of the press arms. The widthwise center of the paper conveying portion substantially matches with a widthwise center between the pair of press roller bearings.

With this configuration, the locations where pressure is applied by the press arm (locations of applied pressure) can be adjusted by the curved part, which is positioned such that the widthwise center of the pressure applied by the press arm (locations of applied pressure) and the center of the paper can easily be made to substantially coincide.

In the image forming apparatus according to the third aspect of the present invention, a concave-shaped part is formed in the feed roller bearing support portion of the curved part on a side away from the press roller so as to bear the pressure from the press roller on the feed roller.

With such a configuration, the press roller bearings to which the pressure applied by the press roller is transmitted via the feed roller are supported while being pressed into the side of the concave-shaped part in the feed roller bearing support unit. Thus, the feed roller bearings are therefore not likely to move horizontally. It is thereby possible to prevent the feed roller bearings from moving horizontally as a result of fluctuations in the load on the paper during printing, and misalignments in the positions of the feed roller bearings can therefore be prevented. As a result, the precision with which paper is fed can be improved.

The image forming apparatus according to the fourth aspect of the present invention preferably further includes a print head pivotably supported between the first and second side surfaces; a platen roller rotatably supported between the first and second side surfaces opposite the print head via a pair of platen roller bearings; and a first side plate mounted on one of the first and second side surfaces of the chassis, the first side plate being unitarily formed with one of the feed roller bearings and one of the platen roller bearings. The curved part further has a platen roller bearing support portion for supporting one of the platen roller bearings.

With such a configuration, it is possible to reduce the number of components and to reduce the number of assembly steps as compared with cases in which the feed roller bearings and the platen roller bearings are provided separately.

The image forming apparatus according to the fifth aspect of the present invention preferably further includes a second side plate mounted on the other of the first and second side surfaces of the chassis, the second side plate being unitarily formed with the other of the feed roller bearings and the other of the platen roller bearings.

In the image forming apparatus according to the sixth aspect of the present invention, the feed roller has the paper conveying portion.

In the image forming apparatus according to the seventh aspect of the present invention, the chassis is made of metal.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiments of the present invention will now be described with reference to the diagrams.

Figure 1:
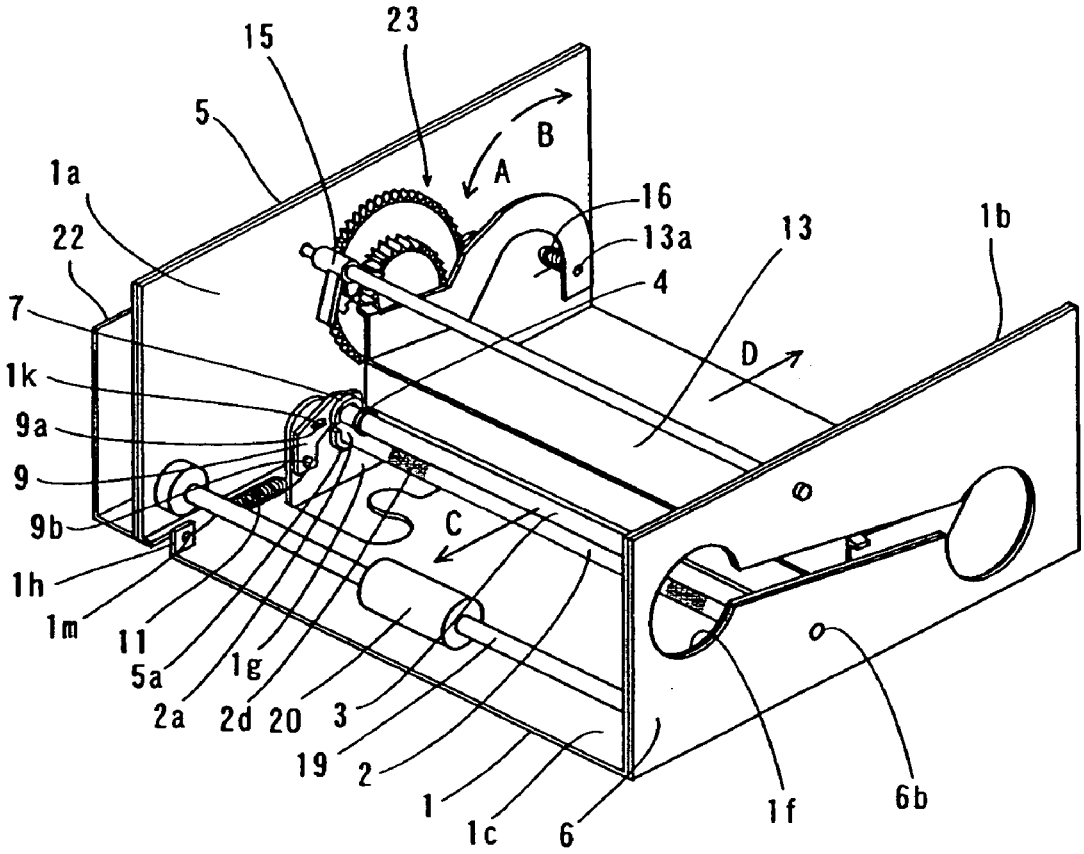
FIG. 1 is a perspective view of the entire configuration of the heat transfer printer according to one embodiment of the present invention.
Figure 2:
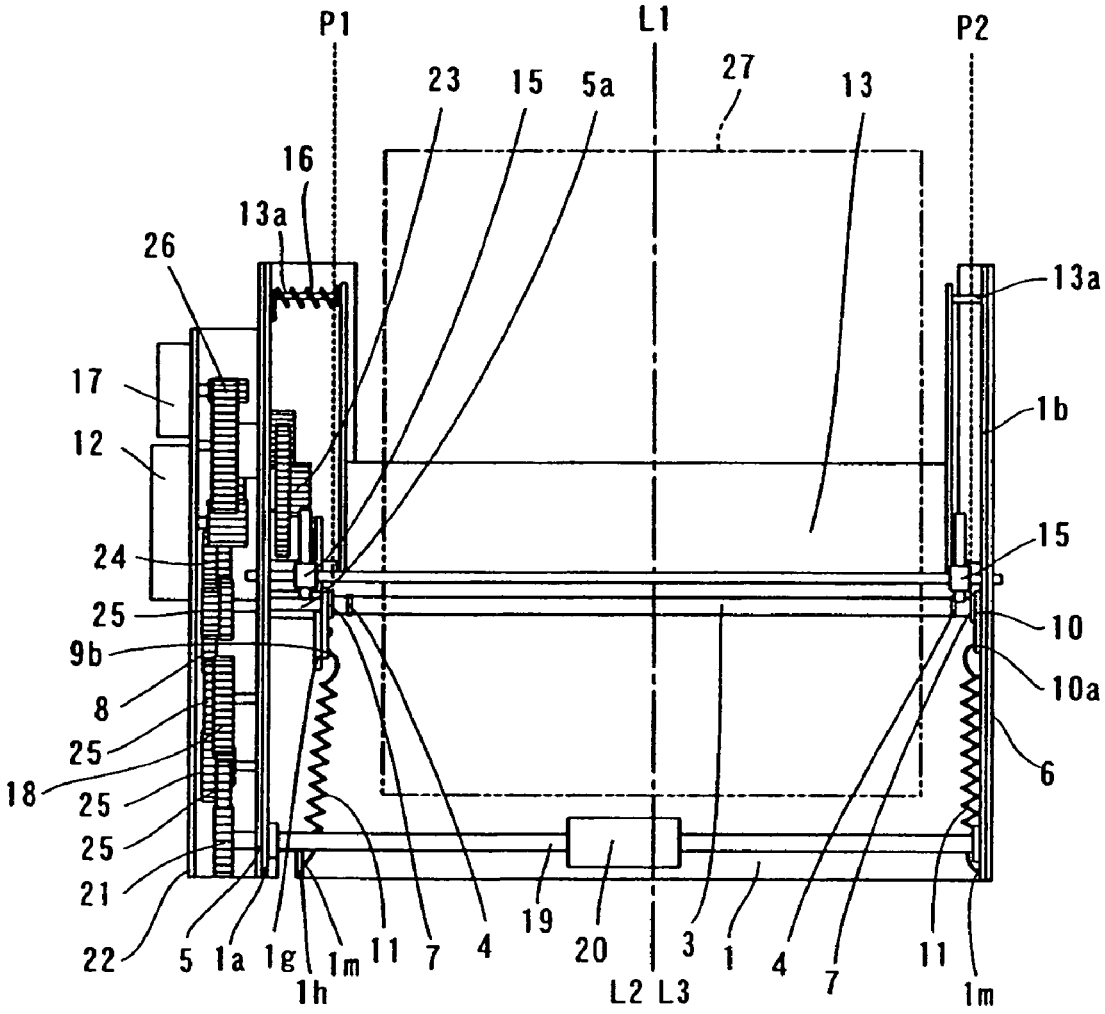
FIG. 2 is a plan view of the heat transfer printer according to the embodiment shown in FIG. 1.
Figure 3:
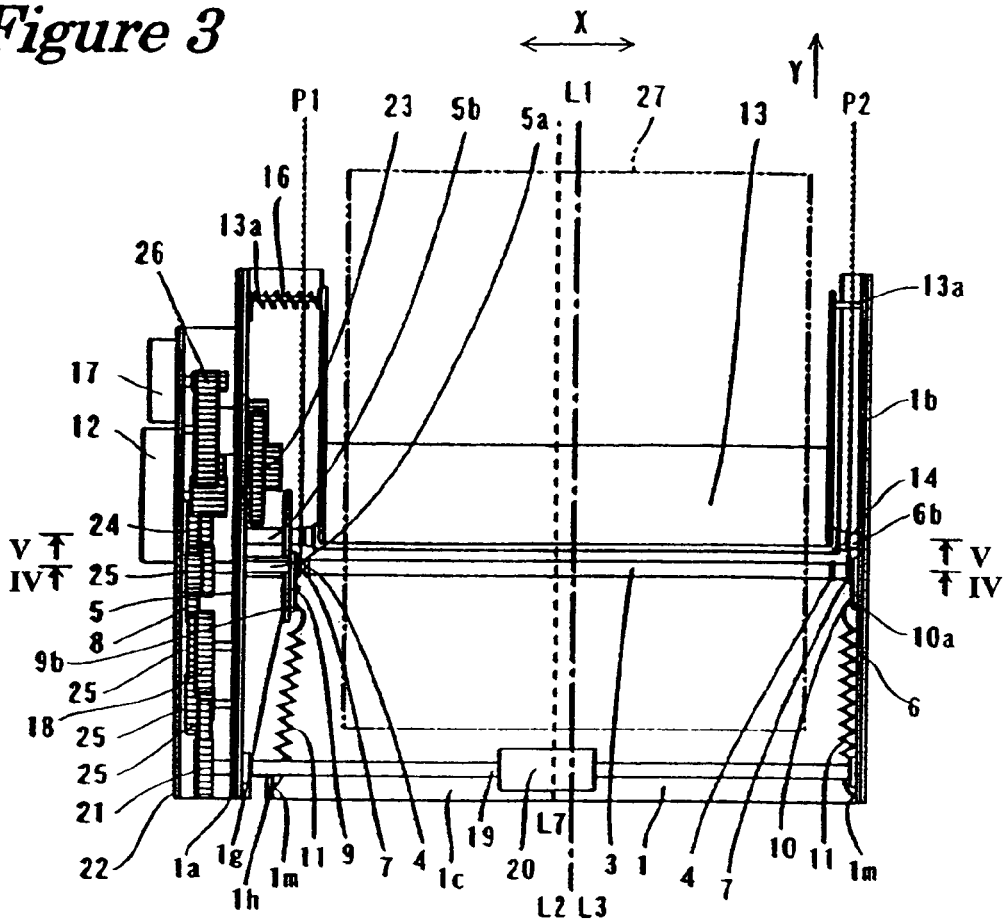
FIG. 3 is a plan view of the heat transfer printer according to the embodiment shown in FIG. 1, with the pressing member being omitted.

FIG. 1 is a perspective view of the entire configuration of a heat transfer printer according to one embodiment of the present invention. FIG. 2 is a plan view of the heat transfer printer according to the embodiment shown in FIG. 1. FIG. 3 is a plan view of the heat transfer printer according to the embodiment shown in FIG. 1, with the pressing member being omitted. FIGS. 4 through 11 are diagrams for describing the detailed structure of the heat transfer printer shown in FIG. 1. The structure of the heat transfer printer according to one embodiment of the present invention will now be described with reference to FIGS. 1 through 11. In the present embodiment, a heat transfer printer will be described as an example of the image forming apparatus in which the present invention is applied to.

As shown in FIGS. 1 through 3, the heat transfer printer according to one embodiment of the present invention includes a metal chassis 1, a metallic feed roller 2 for conveying paper, a metallic press roller 3 for coming into contact with the feed roller 2 with a specific amount of pressure, a separating member 4, resinous side plates 5 and 6, a pair of resinous press roller bearings 7 for rotatably supporting the press roller 3, a feed roller gear 8 mounted on the feed roller 2, a pair of metallic press arms 9 and 10, tension coil springs 11, a motor 12 for driving the feed roller 2 and the like, a thermal head 13 for printing, a platen roller 14, a pressing member 15 for pressing the thermal head 13 onto the platen roller 14, a torsion coil spring 16, a motor 17 for driving the thermal head 13, an ink sheet take-up gear 18, a roller axle 19, a rubber paper supply/ejection roller 20 mounted on the roller axle 19, a roller axle gear 21 mounted on the roller axle 19, a motor bracket 22, a drive gear 23 for driving the pressing member 15, and intermediate gears 24, 25, and 26. The thermal head 13 is an example of a "print head" in the present invention.

The detailed structure of the chassis 1 according to the present embodiment will now be described with reference to FIGS. 1, 4, and 5. As shown in FIG. 1, the chassis 1 has a first side surface 1*a*, a second side surface 1*b*, and a bottom surface 1*c* connecting the first side surface 1*a* and the second side surface 1*b*. Also, as shown in FIG. 1, the motor bracket 22 described above is mounted on the first side surface 1*a* of the chassis 1.

Figure 4:
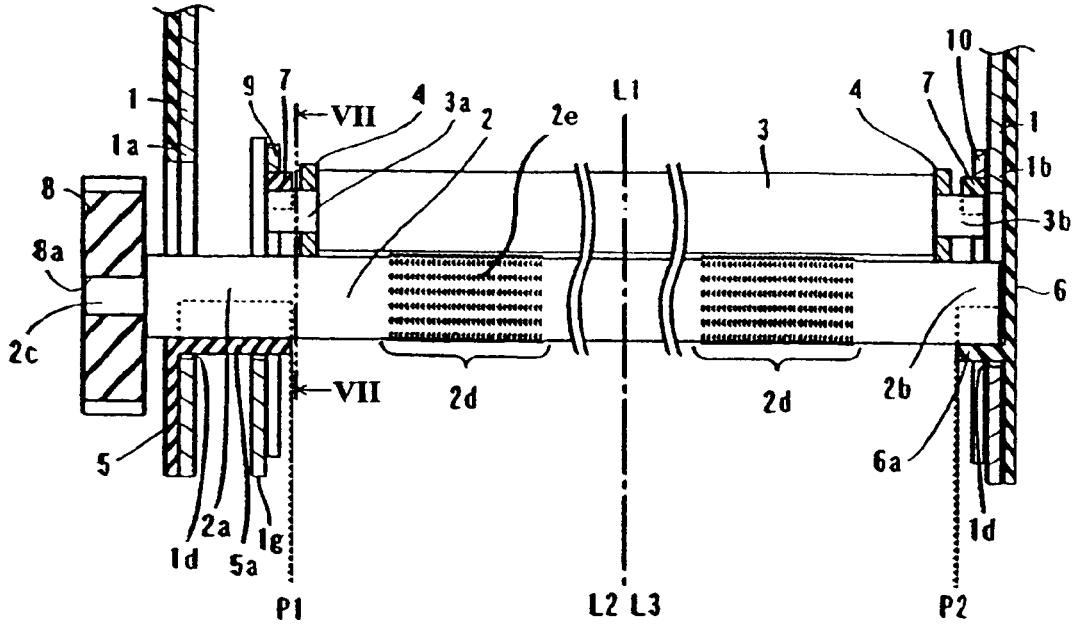
FIG. 4 is a cross-sectional view of the attachment structures of the feed roller and the press roller, viewed along the line IV-IV in FIG. 3.
Figure 5:
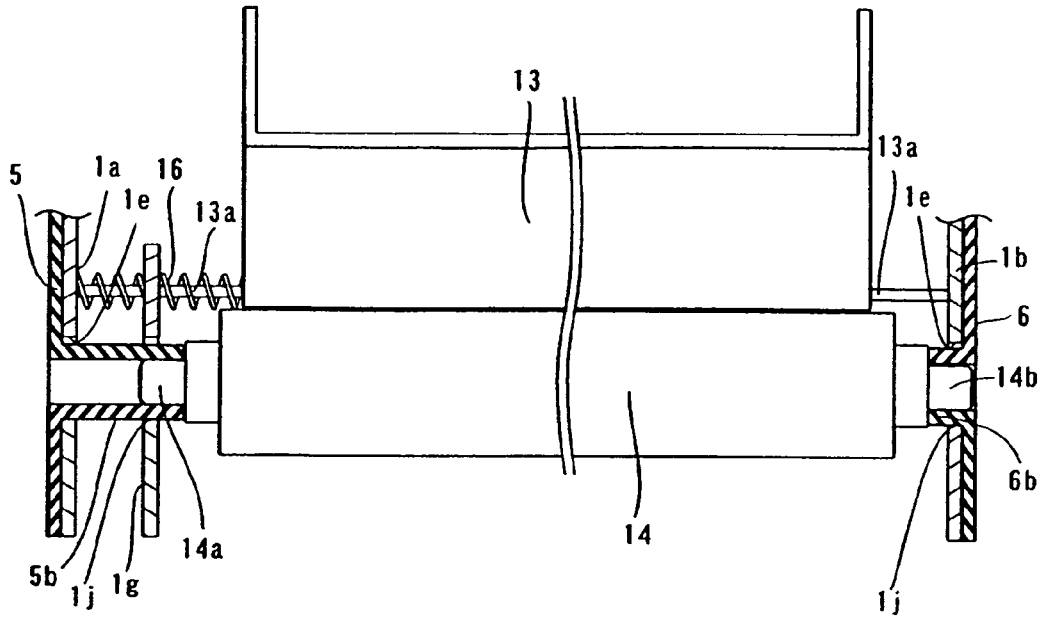
FIG. 5 is a cross-sectional view of the attachment structure of the platen roller, viewed along the line V-V in FIG. 3.

A resinous side plate 5 is also mounted on the first side surface 1*a* of the chassis 1 as shown in FIGS. 4 and 5. The first side surface 1*a* of the chassis 1 has a feed roller bearing insertion hole 1*d* which is for inserting the feed roller bearing 5*a* and is formed unitarily with the resinous side plate 5. The first side surface 1*a* of the chassis 1 also has a platen roller bearing insertion hole 1*e* for inserting the platen roller bearing 5*b* that is formed unitarily with the resinous side plate 5.

A resinous side plate 6 is mounted on the second side surface 1*b* of the chassis 1. The second side surface 1*b* also has a feed roller bearing insertion hole 1*d* for inserting the feed roller bearing 6*a* that is formed unitarily with the resinous side plate 6, and a platen roller bearing insertion hole 1*e* for inserting the platen roller bearing 6*b* that is formed unitarily with provided integrally to the resinous side plate 6. Also, an ink sheet insertion part 1*f* for mounting ink sheets (not shown) is provided to the second side surface 1*b* of the chassis 1, as shown in FIG. 1.

Figure 8:
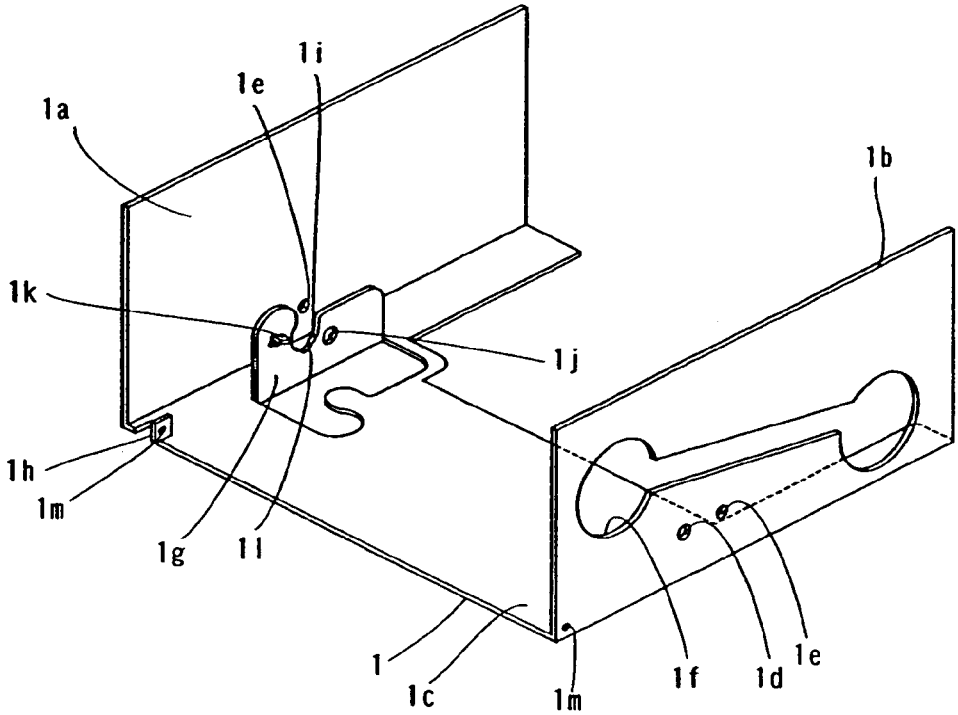
FIG. 8 is a perspective view of the chassis alone in the heat transfer printer according to the embodiment shown in FIG. 1.
Figure 9:
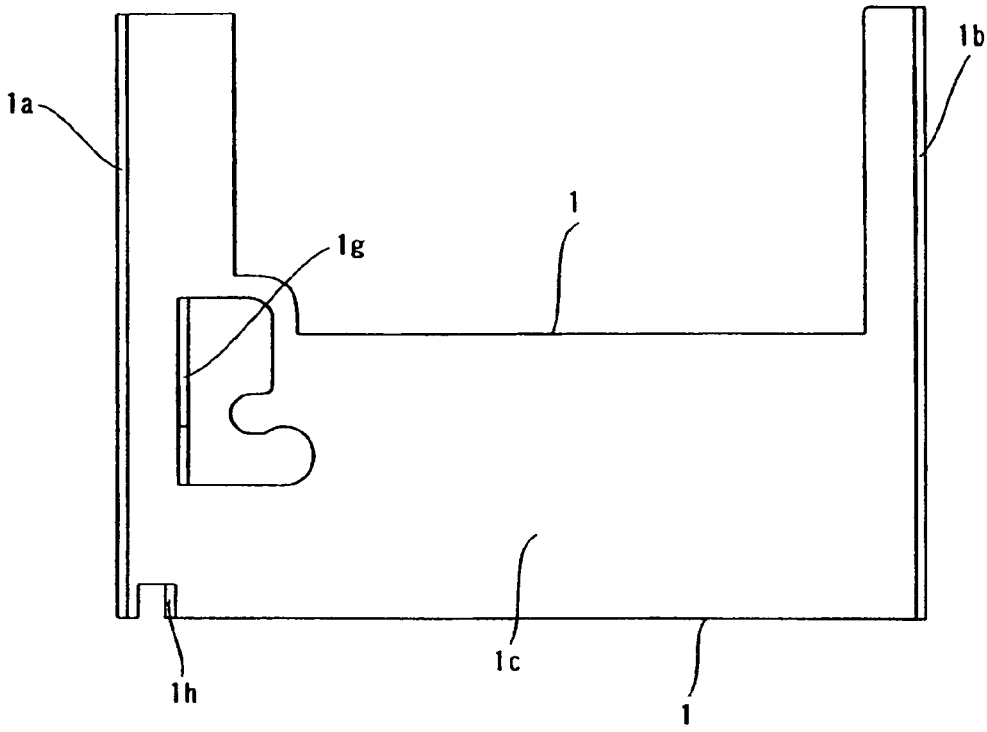
FIG. 9 is a plan view of the chassis alone in the heat transfer printer according to the embodiment shown in FIG. 1.
Figure 10:
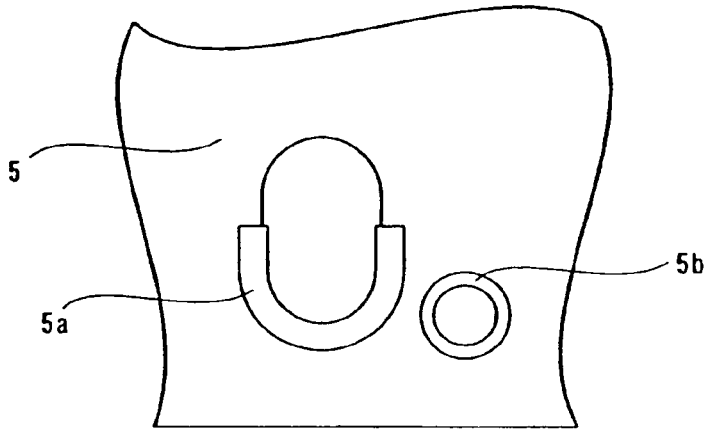
FIG. 10 is a partial schematic front view of the side plate alone mounted on the first side surface in the heat transfer printer according to the embodiment shown in FIG. 1.
Figure 11:
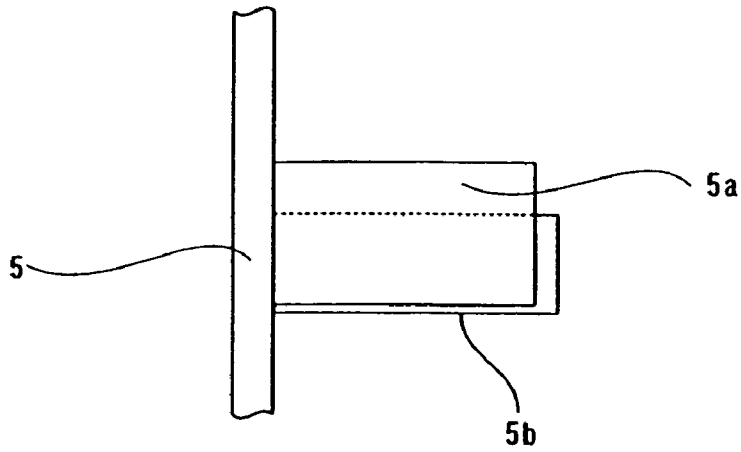
FIG. 11 is a partial schematic side view of the side plate alone mounted on the first side surface in the heat transfer printer according to the embodiment shown in FIG. 1.

In the present embodiment, as shown in FIGS. 8 and 9, the bottom surface 1*c* of the metal chassis 1 includes a curved part 1*g* formed unitarily on the bottom surface 1*c*, and a spring mounting unit 1*h* formed unitarily on the bottom surface 1*c*. The spring mounting unit 1*h* is for mounting one end of the tension coil spring 11 on the first side surface 1*a* side. The curved part 1*g* and the spring mounting unit 1*h* are formed by cutting out portions of the bottom surface 1*c* of the chassis 1.

Figure 7:
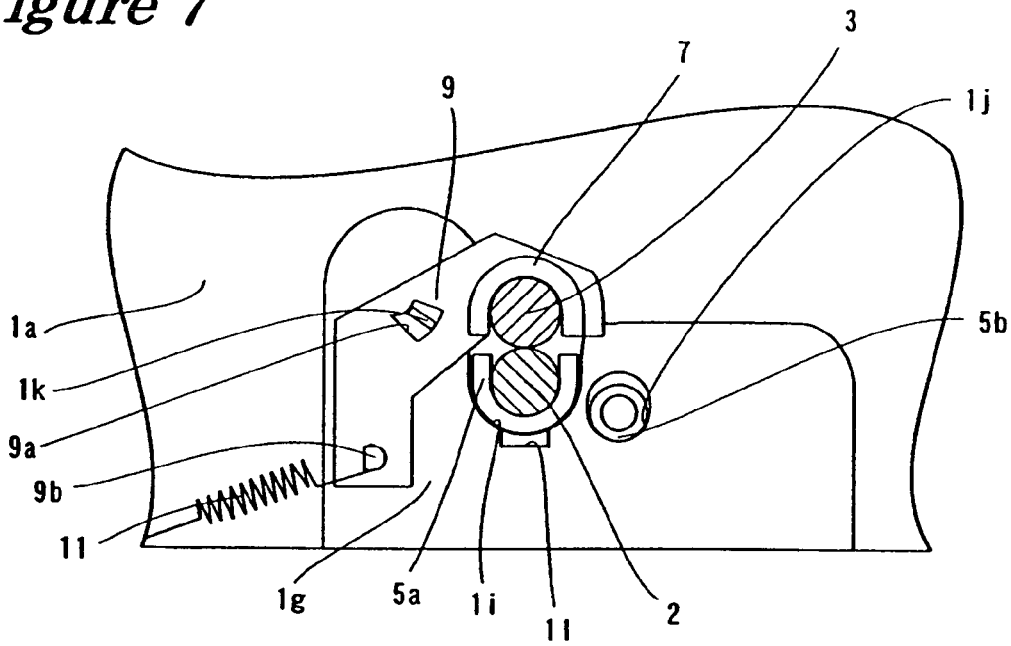
FIG. 7 is a schematic plan view of the curved portion, viewed along the line VII-VII in FIG. 4.

As shown in FIGS. 7 and 8, the curved part 1*g* has a feed roller bearing support portion 1*i* for supporting the feed roller bearing 5*a* that is provided unitarily with the side plate 5, a platen roller bearing support portion 1*j* for supporting the platen roller bearing 5*b* that is provided unitarily with the side plate 5, and a press arm support portion 1*k* for rotatably supporting the press arm 9.

Figure 6:
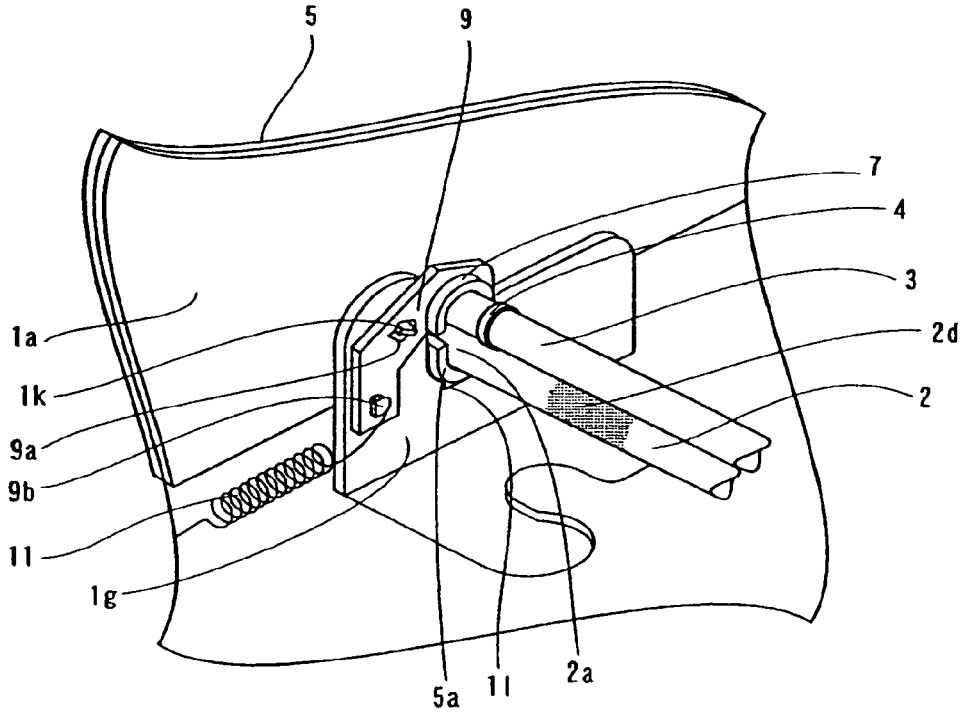
FIG. 6 is a partial perspective view of the curved part and the press arm of the heat transfer printer according to the embodiment shown in FIG. 1.

The second side surface 1*b* also has a feed roller bearing support portion 1*i* for supporting the feed roller bearing 6*a* that is provided unitarily with the side plate 6, and a platen roller bearing support portion 1*j* for supporting the platen roller bearing 6*b* that is provided unitarily with the side plate 6. As shown in FIGS. 6 through 8, the feed roller bearing support portion 1*i* is provided with a concavity 1*l*, which is further depressed from the feed roller bearing support portion 1*i*, on a side away from the press roller 3 so as to bear the pressure applied to the feed roller 2 by the press roller 3.

Also, the spring mounting unit 1*h* is provided with a spring mounting hole 1*m* in which one end of the tension coil spring 11 on the first fist side surface 1*a* side is mounted, as shown in FIG. 8.

Another feature of the present embodiment, as shown in FIG. 4, is that the feed roller 2 has a bearing support portion 2*a* on the side of the first side surface 1*a* of the chassis 1 with, a bearing support portion 2*b* on the side of the second side surface 1*b* of the chassis 1, a gear insertion part 2*c*, and a paper conveying portions 2*d*. The bearing support portions 2*a* and 2*b* of the feed roller 2 have substantially the same diameter as that of the outermost periphery of the portion of the feed roller 2 between the bearing support portions 2*a* and 2*b*. Also, the bearing support portion 2*a* is rotatably supported by the feed roller bearing 5*a* that is formed unitarily with the resinous side plate 5. The bearing support portion 2*b* is rotatably supported by the feed roller bearing 6*a* formed unitarily with the resinous side plate 6. The gear insertion part 2*c* on the outer side of the bearing support portion 2*a* fits into the insertion hole 8*a* in the feed roller gear 8 so as not to be relatively rotatable. Also, convex portions 2*e* (an example of the projecting portions) having a specific height are formed by the roll-forming on the surface of the paper conveying portions 2*d* of the feed roller 2. The paper conveying portion 2*d* is a portion of the surface of the feed roller 2 where the convex portions 2*e* are formed.

The bearing support portions 3*a* and 3*b* of the press roller 3 have a smaller diameter than that of the outermost periphery of the portion of the press roller 3 between the bearing support portions 3*a* and 3*b*, as shown in FIG. 4. The metallic separating member 4 having a greater diameter than that of the press roller 3 is mounted onto the bearing support portions 3*a* and 3*b* of the press roller 3. The distal end of the convex portions on the paper conveying portions 2*d* of the feed roller 2 are thereby prevented from coming into contact with the press roller 3 due to the separating member 4 coming into contact with the outermost peripheral surface of the feed roller 2. Also, the bearing support portions 3*a* and 3*b* of the press roller 3 are rotatably supported by the press roller bearing 7.

The feed roller bearing 5*a* and the platen roller bearing 5*b* that are provided unitarily with the side plate 5 are both longer in the axial direction than the feed roller bearing 6*a* and the platen roller bearing 6*b* that are provided unitarily with the side plate 6. Accordingly, the feed roller bearing 5*a* and the platen roller bearing 5*b* can be supported by the feed roller bearing support portion 1*i* and the platen roller bearing support portion 1*j* of the curved part 1*g*, which is provided unitarily with the bottom surface 1*c*. Also, the feed roller bearings 5*a* and 6*a* are formed to be open at the top, as shown in FIG. 4.

Another feature of the present embodiment is that the press roller bearings 7 are open at the portion facing the feed roller 2, as shown in FIGS. 4, 6, and 7. The press roller bearings 7 are mounted on the press arms 9 and 10 that are provided to the inner sides of the curved part 1*g* and the second side surface 1*b* of the chassis 1, respectively.

Also, as shown in FIG. 7, the press arms 9 has an insertion hole 9*a* for inserting the press arm support portion 1*k* provided to the curved part 1*g*, and a spring mounting portion 9*b* for mounting one end of the tension coil spring 11. The other press arm 10 has an arm support unit (not shown) and a spring mounting portion 10*a* (see FIG. 2) for mounting the tension coil spring 11 on the second side surface 1*b* side. The press arm 9 is also pivotably mounted on the press arm support portion 1*k* of the curved part 1*g*, as shown in FIG. 6. The press arm 10 provided to the second side surface 1*b* side is pivotably mounted on the press arm support portion (not shown) provided to the second side surface 1*b*. Also, the first ends of the two tension coil springs 11 for urging the press roller 3 in a direction in which pressure is applied to the feed roller 2 are respectively mounted in the spring mounting holes 1*m* of the spring mounting unit 1*h* and the second side surface 1*b*. The other ends of the tension coil springs 11 are mounted in the spring mounting portion 9*b* of the press arm 9 and the spring mounting portion 10*a* of the press arm 10, respectively.

Also, as shown in FIGS. 1 and 5, the thermal head 13 is mounted on the inner sides of the first side surface 1*a* and second side surface 1*b* of the chassis 1 to be capable of pivoting around a support axle 13*a*. The torsion coil spring 16 is mounted on this support axle 13*a*. The torsion coil spring 16 urges the thermal head 13 in a direction away from the platen roller 14 (the direction of the arrow B in FIG. 1). Also, when the thermal head 13 receives the driving force from the motor 17 transmitted via the drive gear 23 and the pressing member 15, the thermal head 13 pivots in the direction of the arrow A in FIG. 1 and presses on the platen roller 14 while paper is conveyed.

The platen roller 14 has a bearing support portion 14*a* on the side of the first side surface 1*a* of the chassis 1, and a bearing support portion 14*b* on the side of the second side surface 1*b* of the chassis 1, as shown in FIG. 5. The bearing support portion 14*a* is rotatably supported by the platen roller bearing 5*b* that is formed unitarily with the side plate 5. The bearing support portion 14*b* is rotatably supported in the platen roller bearing 6*b* that is formed unitarily with the side plate 6.

The feed roller gear 8 receives the drive force from the motor 12 transmitted via the intermediate gear 24, as shown in FIGS. 2 and 3. The motor 12 is mounted on the motor bracket 22. Also, the motor 12 functions as a drive source for driving the feed roller 2, the ink sheet take-up member (not shown), and the roller axle 19. The feed roller gear 8 engages the intermediate gears 24 and 25.

The intermediate gears 25 transmit the drive force from the feed roller gear 8 to the ink sheet take-up gear 18 that is fitted over the ink sheet take-up roller (not shown). Also, the intermediate gears 25 transmit the drive force from the feed roller gear 8 via the roller axle gear 21 to the roller axle 19, on which the paper supply/ejection roller 20 is mounted.

The relationship between the positions of the feed roller 2, the press roller 3, and the paper 27 in the heat transfer printer according to the present embodiment will now be described with reference to FIG. 3. The center position of the paper 27 in the width direction (the direction of the arrow X in FIG. 3), which is orthogonal to the conveyance direction (the direction of the arrow Y in FIG. 3) of the paper 27 is denoted by L1, the center position (center line) of the distance between the feed roller bearings 5*a* and 6*a* is denoted by L2, and the center position (center line) of the distance between the press roller bearings 7 is denoted by L3. The center position of the distance between the first side surface 1*a* and the second side surface 1*b* is denoted by L7. Also, the distal position of the feed roller bearing 5*a* is denoted by P1, and the distal position of the feed roller bearing 6*a* is denoted by P2. Here, the center position L1 is also the center position of the paper conveying portions 2*d*.

In the present embodiment, as shown in FIG. 3, the center position L1 of the paper 27 is shifted toward the second side surface 1*b* of the chassis 1 away from the center position L4 of the distance between the first side surface 1*a* and second side surface 1*b* of the chassis 1 because the drive gear 23 that drives the pressing member 15 for pressing on the thermal head 13 is disposed on the inner surface of the first side surface 1*a*.

In view of this, in the present embodiment, as shown in FIGS. 2 through 4, the curved part 1*g* that supports the press arm 9 on which the feed roller bearing 5*a* and the press roller bearing 7 are mounted is provided at the bottom surface 1*c* of the chassis 1. Furthermore, the position where the curved part 1*g* is formed is set such that when the paper 27 is conveyed, there is a substantial match among the center position L1 of the paper 27, the center position L2 of the distance between the feed roller bearings 5*a* and 6*a*, and the center position L3 of the distance between the press roller bearings 7.

Figure 12:
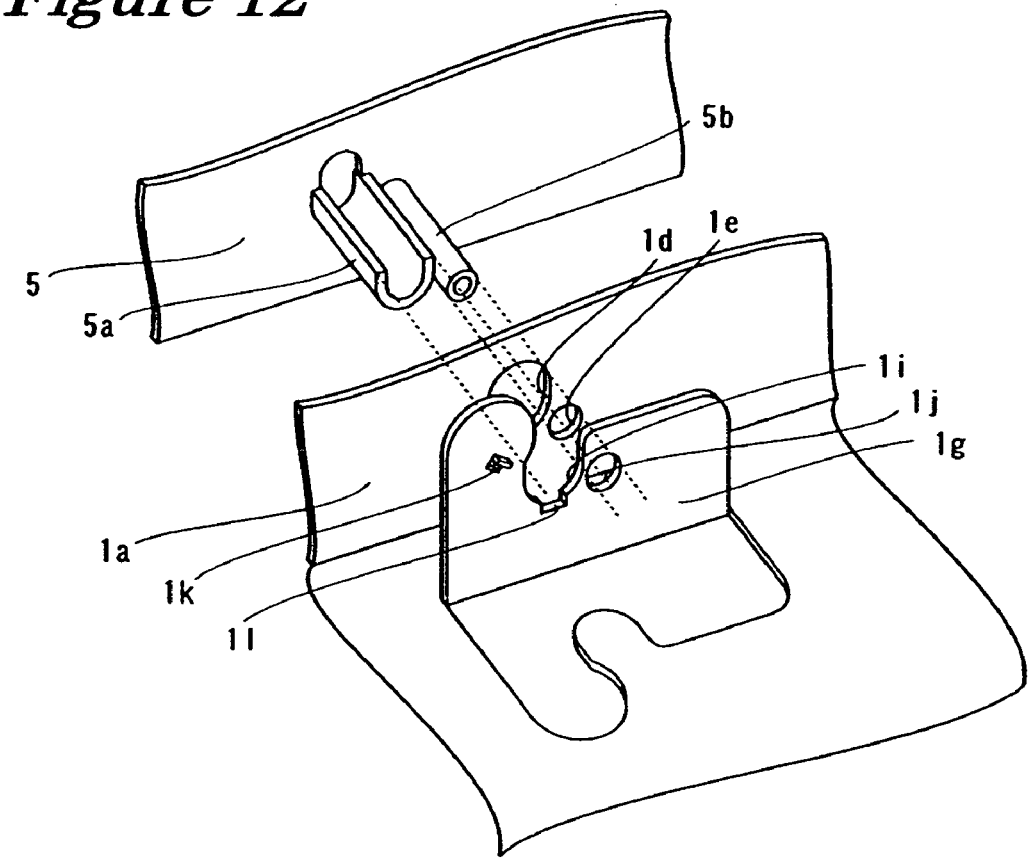
FIG. 12 is a perspective exploded view of the chassis and the side plate for describing the manner in which the side plate is mounted on the chassis in the heat transfer printer according to the embodiment shown in FIG. 1.

Next, the method for mounting the side plate 5 on the chassis 1 and the curved part 1*g* in the heat transfer printer according to the present embodiment will be described with reference to FIGS. 12 and 13. When the side plate 5 is mounted on the curved part 1*g* of the chassis 1 in the heat transfer printer of the present embodiment, the feed roller bearing 5*a* and the platen roller bearing 5*b* that are formed unitarily in the side plate 5 are inserted as shown in FIG. 12 so as to protrude to the inner side of the first side surface 1*a* through the feed roller bearing insertion hole 1*d* and the platen roller bearing insertion hole 1*e* of the first side surface 1*a* of the chassis 1.

Figure 13:
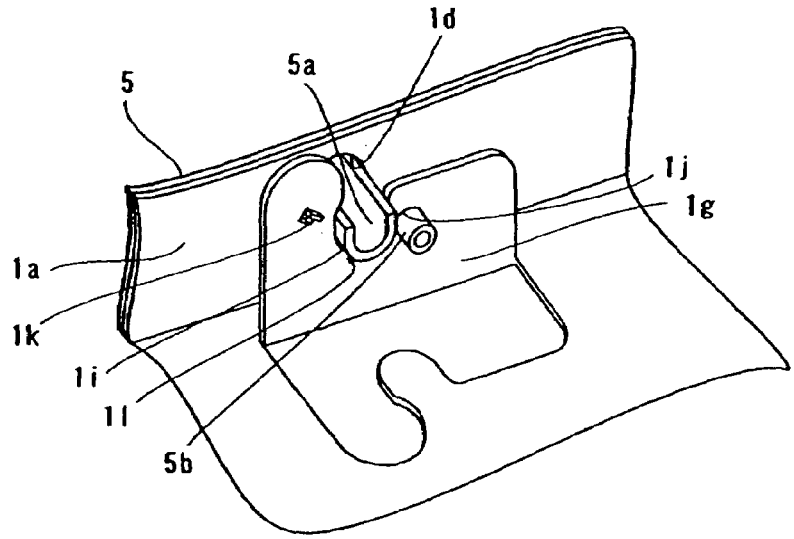
FIG. 13 is a perspective view of the chassis and the side plate for describing the manner in which the side plate is mounted on the chassis in the heat transfer printer according to the embodiment shown in FIG. 1.
Figure 14:
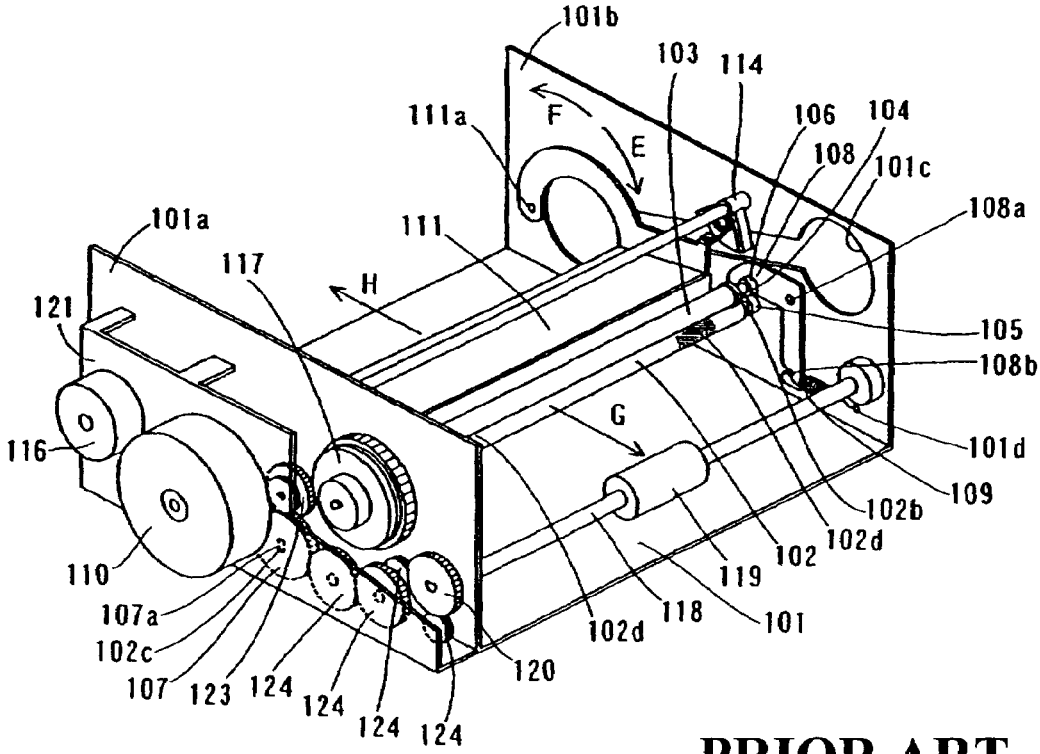
FIG. 14 is a perspective view of the entire configuration of a conventional heat transfer printer.
Figure 15:
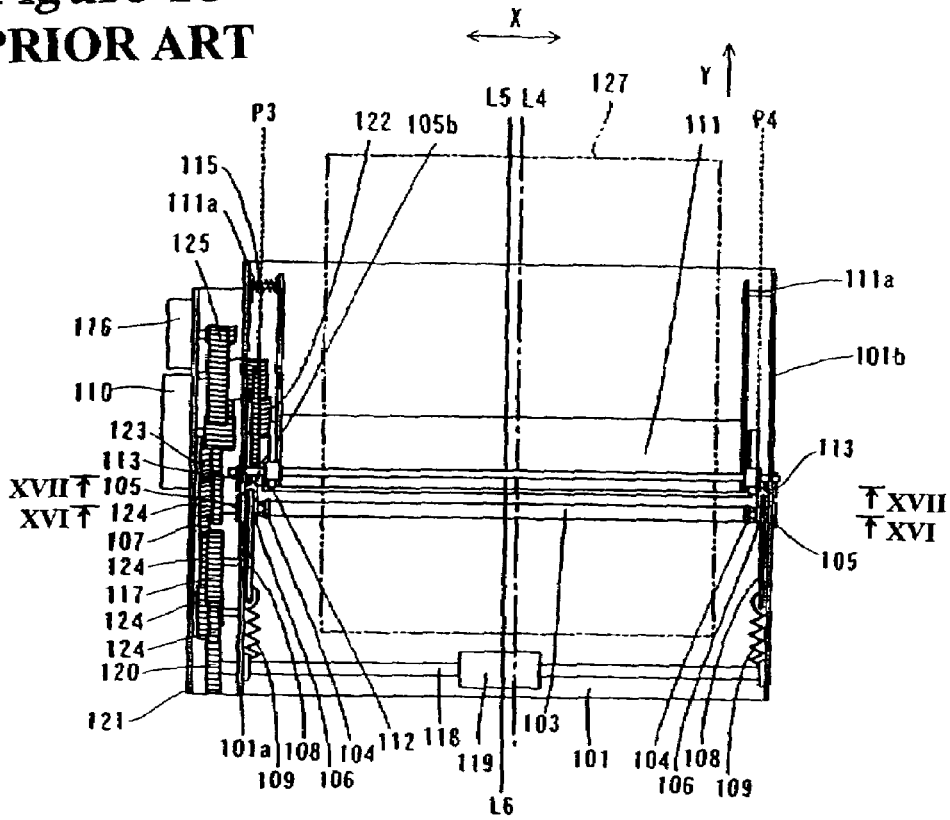
Figure 15 PRIOR ART
FIG. 15 is a plan view of the conventional heat transfer printer shown in FIG. 14.
Figure 16:
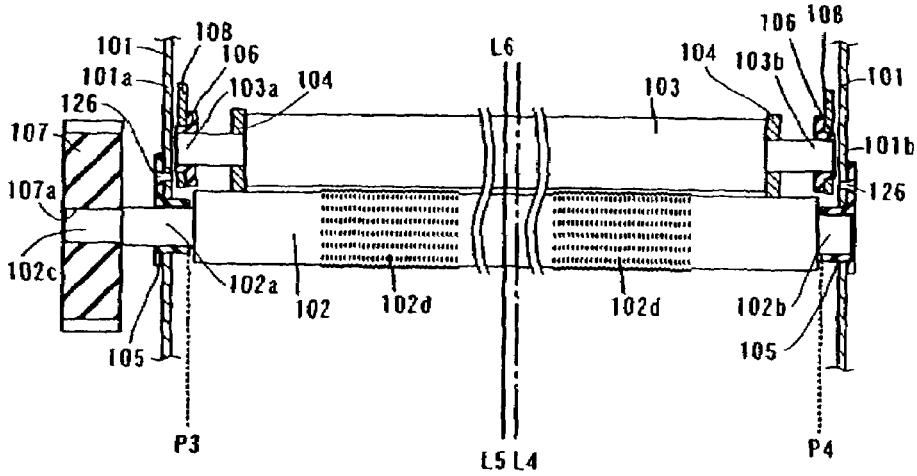
Figure 16 PRIOR ART
FIG. 16 is a cross-sectional view of the conventional heat transfer printer viewed along the line XVI-XVI in FIG. 15.
Figure 17:
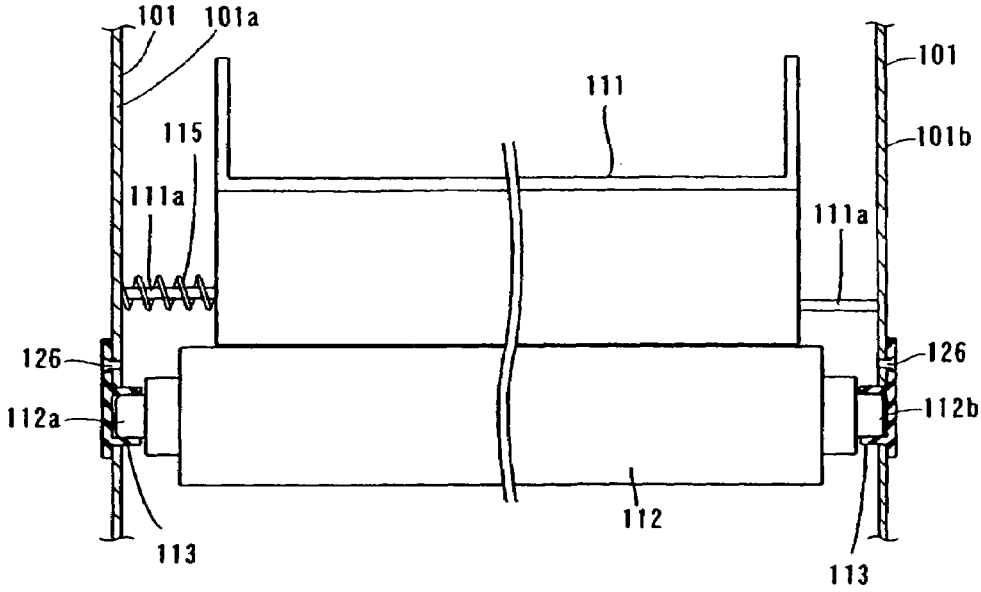
Figure 17 PRIOR ART
FIG. 17 is a cross-sectional view of the conventional heat transfer printer viewed along the line XVII-XVII in FIG. 15.
Figure 18:
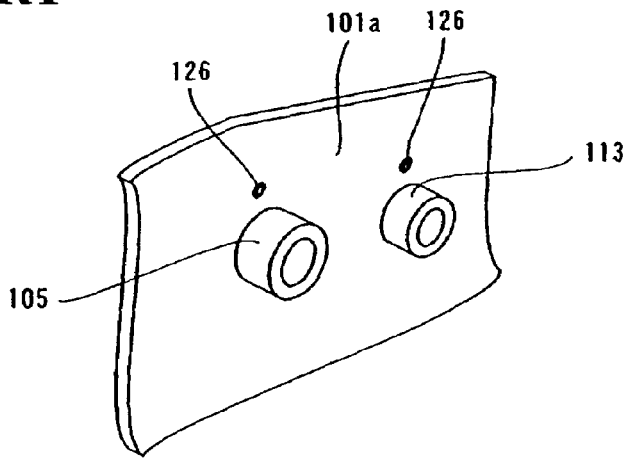
Figure 18 PRIOR ART
FIG. 18 is a partial perspective view showing the structure of the bearings mounted on the second side surface of the chassis of the conventional heat transfer printer shown in FIG. 14.
Figure 19:
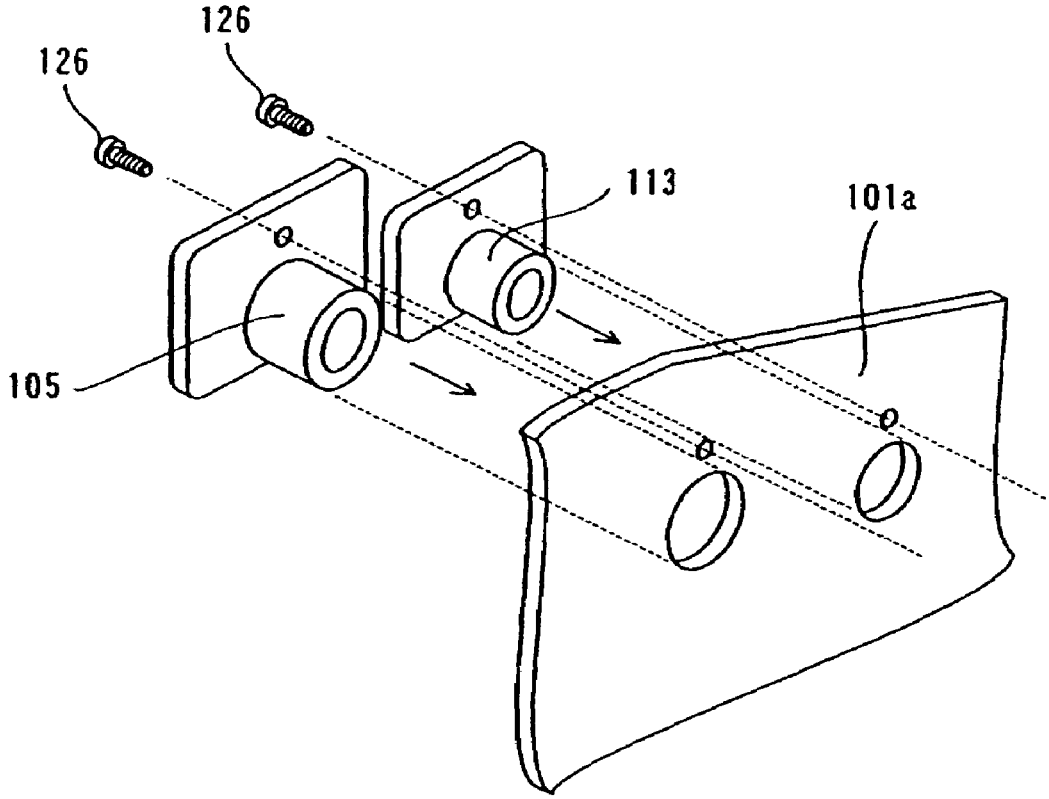
Figure 19 PRIOR ART
FIG. 19 is a perspective exploded view for describing the manner in which the bearings are mounted on the second side surface of the chassis in the conventional heat transfer printer shown in FIG. 14.

Then, as shown in FIG. 13, the feed roller bearing 5*a* protruding into the inner surface of the first side surface 1*a* is disposed so as to be supported by the feed roller bearing support portion 1*i* of the curved part 1*g* that is provided unitarily on the bottom surface 1*c* of the chassis 1. The platen roller bearing 5*b* formed unitarily in the side plate 5 is also disposed so as to be supported by the platen roller bearing support portion 1*j* of the curved part 1*g*. In this manner, the feed roller bearing 5*a* and the platen roller bearing 5*b* that are provided unitarily in the side plate 5 are mounted in the curved part 1*g* of the chassis 1.

Next, the operation of feeding the paper 27 in the heat transfer printer according to one embodiment of the present invention will be described with reference to FIGS. 1 through 3. In the operation of feeding the paper 27 in the heat transfer printer of the present embodiment, the driving force from the motor 12 is transmitted to the feed roller gear 8 via the intermediate gear 24, as shown in FIGS. 2 and 3. The feed roller 2 thereby rotates. Also, the driving force from the motor 12 is transmitted from the feed roller gear 8 to the ink sheet take-up gear 18 via the intermediate gear 25, and the ink sheet (not shown) is rolled as a result. The driving force from the motor 12 is also transmitted from the feed roller gear 8 to the roller axle gear 21 via the plurality of intermediate gears 25, and the paper 27 is conveyed in either the supply direction or the ejection direction as a result.

As shown in FIG. 1, the thermal head 13 is pivoted in a direction in which pressure is applied to the platen roller 14 (the direction of the arrow A) by the motor 17 during the printing operation, and pivots in a direction away from the platen roller 14 (the direction of the arrow B) when paper is conveyed in the direction of the arrow D. During the printing operation, the paper 27 is held between the thermal head 13 and the platen roller 14, and is conveyed in the direction of the arrow C by the feed roller 2 and the press roller 3. When the paper 27 is conveyed in the direction of the arrow D, the thermal head 13 pivots in a direction away from the platen roller 14 (the direction of the arrow B) while the paper 27 is conveyed by the feed roller 2 and the press roller 3.

In the present embodiment, as described above, the curved part 1*g* having a feed roller bearing support portion 1*i* for supporting the feed roller bearing 5*a*, a platen roller bearing support portion 1*j* for supporting the platen roller bearing 5*b*, and a press arm support portion 1*k* for pivotably supporting the press arm 9 are provided to the bottom surface 1*c* of the chassis 1. Particularly, the curved part 1*g* is positioned such that when the paper 27 is conveyed, there is a substantial match among the width direction center position L1 of the paper 27, the center position L2 of the distance between the feed roller bearings 5*a* and 6*a*, and the center position L3 of the distance between the pair of press roller bearings 7 mounted on the press arms 9 and 10. Accordingly, the center position L2 of the distance between the feed roller bearings 5*a* and 6*a* and the center position L3 of the distance between the pair of press roller bearings 7 can be made to substantially coincide with the center position L1 of the paper 27. Therefore, the width-wise center of the pressure applied by the press roller 3 to the feed roller 2, in other words the width-wise center of the pressure applied by the press arms 9 and 10, which are disposed where the press roller bearings 7 are mounted, can thereby be made to substantially coincide with the center position L1 of the paper 27. Thus, the pressure applied to the paper 27 by the press roller 3 can be uniform in the transverse direction. As a result, the printing quality can be improved because the precision with which paper 27 is fed can be improved.

The above-described structure can be formed without having to increase the number of components, since the curved part 1*g* having the feed roller bearing support portion 1*i* is formed unitarily on the bottom surface 1*c* of the chassis 1. Thus, the precision with which paper 27 is fed can be improved without increasing the number of components.

Another feature of the present embodiment is that the feed roller bearing 5*a* that receives the pressure from the press roller 3 via the feed roller 2 is supported by the concavity 1*l* of the feed roller bearing support portion 1*i*, since the concavity 1*l* is formed on the side of the feed roller bearing support portion 1*i* of the curved part 1*g* that bears the pressure from the press roller 3. Therefore, the feed roller bearing 5*a* is not likely to move horizontally. The feed roller bearing 5*a* can be prevented from moving horizontally even with fluctuations in the load on the paper 27 during printing. Accordingly misalignments in the positions of the feed roller bearing 5*a* can therefore be suppressed. As a result, the precision with which paper 27 is fed can be improved.

Another feature of the present embodiment is that, by providing the curved part 1*g* having the press arm support portion 1*k* that rotatably supports the press arm 9, it is possible to adjust the position at which pressure is applied by the press arm 9 (points of pressure application) by adjusting the position of the curved part 1*g*. Therefore, the center between the positions where pressure is applied by the press arms 9 and 10 and the center of the paper 27 can be made to substantially coincide by adjusting the position of the curved part 1*g*.

Another feature of the present embodiment is that, the side plate 5 has unitarily formed therewith the feed roller bearing 5*a*, which rotatably supports the feed roller 2, and the platen roller bearing 5*b*, which rotatably supports the platen roller 14. Also, the side plate 6 has unitarily formed therewith the feed roller bearing 6*a*, which rotatably supports the feed roller 2, and the platen roller bearing 6*b*, which rotatably supports the platen roller 14. It is thereby possible to reduce the number of components and to reduce the number of assembly steps in comparison with cases in which the feed roller bearings 5*a* and 6*a* and the platen roller bearings 5*b* and 6*b* are provided separately.

The embodiment disclosed above should be considered as merely an example in all respects and not as being restrictive. The range of the present invention is expressed by the patent claims and not by the above descriptions of the embodiment, and further has meanings equivalent to the range of the patent claims and all variations thereof.

For example, in the embodiment described above, a heat transfer printer is given as an example of an image forming apparatus. However, the present invention is not limited thereto, and can also be applied to image forming apparatuses other than heat transfer printers, as long as such image forming apparatus has a feed roller and a press roller.

Also, in the embodiment described above, a concavity is formed in the feed roller bearing support portion of the curved part, so as to receive the pressure applied from the press roller to the feed roller. However, the present invention is not limited thereto, and it is also possible not to form the concavity.

Also, in the embodiment described above, the side plate is unitarily formed with the platen roller bearings and the feed roller bearings. However, the present invention is not limited to such construction, and the feed roller bearings and platen roller bearings may also be formed separately.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-205535. The entire disclosure of Japanese Patent Application No. 2004-205535 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising:

a chassis with a first side surface, a second side surface, a bottom surface that connects the first and second side surfaces, and a curved part formed unitarily with the bottom surface, the curved part having a feed roller bearing support portion;

a print head supported by the chassis;

a feed roller rotatably supported between the first and second side surfaces via a pair of feed roller support bearings for conveying paper, one of the feed roller support bearings being supported by the first side surface and the feed roller bearing support portion of the curved part;

and a press roller rotatably supported between the first and second side surfaces for pressing on the feed roller with a predetermined amount of pressure, the feed roller having a paper conveying portion with a plurality of projecting portions, a widthwise center & the paper conveying portion substantially matching with a widthwise center between the pair of feed roller support bearings.

2. The image forming apparatus according to claim 1, further comprising a pair of press roller bearings for rotatably supporting both ends of the press roller; and a pair of press arms for pressing the press roller against the feed roller with a predetermined amount of pressure, each of the pair of press roller bearings being mounted on each of the press arms, the curved part further having a press arm support portion for rotatably supporting one of the press arms, and the widthwise center of the paper conveying portion substantially matching with a widthwise center between the pair of press roller bearings.

3. The image forming apparatus according to claim 1, wherein a concave-shaped part is formed in the feed roller bearing support portion of the curved part on a side away from the press roller so as to bear the pressure from the press roller on the feed roller.

4. The image forming apparatus according to claim 1, wherein the feed roller has the paper conveying portion.

5. The image forming apparatus according to claim 1, wherein the chassis is made of metal.

6. An image forming apparatus comprising:

a chassis with a first side surface, a second side surface, a bottom surface that connects the first and second side surfaces, and a curved part formed unitarily with the bottom surface, the curved part having a feed roller bearing support portion;

a feed roller rotatably supported between the first and second side surfaces via a pair of feed roller support bearings for conveying paper, one of the feed roller support bearings being supported by the feed roller bearing support portion of the curved part;

a press roller rotatably supported between the first and second side surfaces for pressing on the feed roller with a predetermined amount of pressure;

a print head pivotably supported between the first and second side surfaces;

a platen roller rotatably supported between the first and second side surfaces opposite the print head via a pair of platen roller bearings; and a first side plate mounted on one of the first and second side surfaces of the chassis, the first side plate being unitarily formed with one of the feed roller bearings and one of the platen roller bearings, the feed roller or the press roller having a paper conveying portion that has a plurality of projecting portions, a widthwise center of the paper conveying portion substantially matching with a widthwise center between the pair of feed roller bearings, and the curved part further having a platen roller bearing support portion for supporting one of the platen roller bearings.

7. The image forming apparatus according to claim 6, further comprising a second side plate mounted on the other of the first and second side surfaces of the chassis, the second side plate being unitarily formed with the other of the feed roller bearings and the other of the platen roller bearings.

8. An image forming apparatus, comprising:

a metal chassis with a first side surface, a second side surface, a bottom surface that connects the first and second side surfaces, and a curved part formed unitarily with the bottom surface, the curved part having a feed roller bearing support portion, a press arm support portion, and a platen roller bearing support portion;

a feed roller rotatably supported between the first and second side surfaces via feed roller support bearings for conveying paper, one of the feed roller support bearings being supported by the feed roller bearing support portion of the curved part;

a press roller rotatably supported between the curved part and the second side surfaces via a pair of press roller bearings for pressing on the feed roller with a predetermined amount of pressure, the pair of press roller bearings rotatably supporting both ends of the press roller;

first and second side plates mounted on the first and second side surfaces of the chassis, the first and side plates being unitarily formed with the feed roller bearings and the platen roller bearings, a print head pivotably supported between the curved portion and the second side surface;

a platen roller rotatably supported between the curved portion and the second side surface opposite the print head via a pair of platen roller bearings, one of the pair of platen roller bearings being supported by the platen roller bearing support portion of the curved portion; and a pair of press arms for pressing the press roller against the feed roller with a predetermined amount of pressure, each of the pair of press roller bearings being mounted on each of the press arms, one of the press arms being supported by the press arm support portion of the curved portion, wherein the feed roller has a paper conveying portion that has a plurality of projecting portions, a widthwise center of the paper conveying portion substantially matches with a widthwise center between the pair of feed roller bearing and a widthwise center between the pair of press roller bearings, and a concave-shaped part is formed in the feed roller bearing support portion of the curved part on a side away from the press roller so as to bear the pressure from the press roller on the feed roller.

* * * * *